US010753674B1

(12) United States Patent
Brzezina et al.

(10) Patent No.: US 10,753,674 B1
(45) Date of Patent: Aug. 25, 2020

(54) REFRIGERATOR TUCK SHELF WITH FLUSH PROFILE AND CO-INJECTED FIXED GLASS

(71) Applicant: WHIRLPOOL CORPORATION, Benton Harbor, MI (US)

(72) Inventors: Jakub Brzezina, Lubliniec (PL); Marek Gorzelanczyk, Bierzow (PL); Maurizio Valle, Varese (IT); Alberto Galizia, Milan (IT); Karolina Rubaszewska, Wroclaw (PL)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/280,541

(22) Filed: Feb. 20, 2019

(51) Int. Cl.
*F25D 25/02* (2006.01)

(52) U.S. Cl.
CPC ..... *F25D 25/024* (2013.01); *F25D 2325/021* (2013.01); *F25D 2325/022* (2013.01)

(58) Field of Classification Search
CPC .. F25D 25/00; F25D 25/024; F25D 2325/021; F25D 2325/022
USPC ..... 108/71, 72, 73, 108; 312/408
See application file for complete search history.

(56) References Cited

U.S. PATENT DOCUMENTS 774,117 A 11/1904 Tandy
1,997,432 A 4/1935 Replogle
2,412,904 A 12/1946 Money et al.
2,434,117 A 1/1948 Money et al.
2,509,592 A 5/1950 Giffard
2,694,906 A 11/1954 Didion
2,710,993 A 6/1955 Kirkpatrick
2,773,677 A 12/1956 Hinkel
2,804,068 A 8/1957 Miller et al.
3,984,163 A 10/1976 Boorman, Jr. et al.
5,340,209 A * 8/1994 Kolbe ..... F25D 25/024 312/334.46
5,415,472 A 5/1995 Brise
5,447,146 A 9/1995 Nickerson
5,735,589 A 4/1998 Herrmann et al.
6,220,684 B1 4/2001 Bent et al.
(Continued)

FOREIGN PATENT DOCUMENTS

BR MU8802268 U2 2/2010
CN 1975301 A 6/2007
(Continued)

*Primary Examiner* — Jose V Chen
(74) *Attorney, Agent, or Firm* — Price Heneveld LLP

(57) ABSTRACT

A refrigerator shelf includes a frame having laterally spaced-apart first and second side members, defining opposite first and second ends defining first and second portions of a front edge profile of the refrigerator shelf, respectively. A medial member extends between the first and second side members at respective locations between the first and second ends. A first substrate is received between the first and second side members, defines a first edge, and is moveable between an extended position with the first edge adjacent the first ends of the first and second members and a tucked position with the front edge spaced away from the first ends. A trim member extends along an edge of the second substrate and defines a third portion of the front edge profile that is aligned with and physically engages with the first and second portions when the second substrate is in the extended position.

20 Claims, 5 Drawing Sheets

(56) References Cited

U.S. PATENT DOCUMENTS

| | | | | |
|---|---|---|---|---|
| D505,140 | S | 5/2005 | Reed et al. | |
| D516,100 | S | 2/2006 | Vardon | |
| D516,102 | S | 2/2006 | Vardon | |
| D523,034 | S | 6/2006 | Vardon | |
| 7,059,693 | B2 | 6/2006 | Park | |
| D525,633 | S | 7/2006 | Vardon | |
| 7,232,196 | B2 | 6/2007 | Kwon et al. | |
| D551,262 | S | 9/2007 | Becke | |
| 7,726,753 | B2 | 6/2010 | Bassi | |
| 7,878,344 | B2 | 2/2011 | Martin et al. | |
| 7,976,113 | B2 | 7/2011 | Gwak | |
| D656,970 | S | 4/2012 | Merritt | |
| 8,182,056 | B2 | 5/2012 | Gossens et al. | |
| D669,506 | S | 10/2012 | Czach et al. | |
| 8,286,561 | B2 | 10/2012 | Driver et al. | |
| 8,403,438 | B2 | 3/2013 | Park et al. | |
| 8,444,239 | B2 | 5/2013 | Gossens et al. | |
| 8,474,928 | B2 | 7/2013 | Ertz et al. | |
| D692,034 | S | 10/2013 | Seo et al. | |
| 8,562,089 | B2 | 10/2013 | Collins et al. | |
| D694,288 | S | 11/2013 | Hottmann et al. | |
| D694,289 | S | 11/2013 | Hottmann et al. | |
| D694,292 | S | 11/2013 | Eby et al. | |
| 8,596,205 | B2 | 12/2013 | Driver et al. | |
| 8,733,862 | B1 | 5/2014 | Armstrong et al. | |
| D707,267 | S | 6/2014 | Choi et al. | |
| D709,927 | S | 7/2014 | Park et al. | |
| 8,777,341 | B2 * | 7/2014 | Amaral | F25D 25/024 312/408 |
| D710,405 | S | 8/2014 | Seo et al. | |
| D710,406 | S | 8/2014 | Seo et al. | |
| D711,943 | S | 8/2014 | Park et al. | |
| 8,814,287 | B2 | 8/2014 | Jang | |
| 8,840,205 | B2 * | 9/2014 | Chellappan | F25D 23/067 312/408 |
| D714,840 | S | 10/2014 | Yang et al. | |
| D717,349 | S | 11/2014 | Seo et al. | |
| D719,986 | S | 12/2014 | Kim et al. | |
| D734,784 | S | 7/2015 | Kim et al. | |
| 9,103,582 | B2 | 8/2015 | Nash et al. | |
| 9,151,534 | B2 | 10/2015 | Lee et al. | |
| 9,179,773 | B2 | 11/2015 | Driver et al. | |
| D745,581 | S | 12/2015 | Jeon et al. | |
| 9,207,012 | B2 | 12/2015 | Driver et al. | |
| 9,220,341 | B2 | 12/2015 | Dart et al. | |
| D747,369 | S | 1/2016 | McConnell et al. | |
| D747,370 | S | 1/2016 | Kim et al. | |
| D747,371 | S | 1/2016 | Lee et al. | |
| D747,372 | S | 1/2016 | Kim et al. | |
| D747,373 | S | 1/2016 | Lee et al. | |
| D748,165 | S | 1/2016 | McConnell et al. | |
| 9,297,573 | B2 | 3/2016 | Krause et al. | |
| D754,759 | S | 4/2016 | McConnell et al. | |
| D756,551 | S | 5/2016 | Handt et al. | |
| 9,335,089 | B1 | 5/2016 | Gossens | |
| D761,884 | S | 7/2016 | Austin et al. | |
| 9,453,673 | B2 | 9/2016 | Gossens | |
| 9,510,679 | B2 | 12/2016 | Bhatt et al. | |
| 9,532,649 | B2 | 1/2017 | Driver et al. | |
| 9,574,820 | B2 | 2/2017 | Lee | |
| 9,671,115 | B2 | 6/2017 | Elkasevic | |
| 9,945,601 | B1 | 4/2018 | Bhaysar et al. | |
| 9,993,072 | B2 | 6/2018 | Azkue et al. | |
| 10,017,971 | B2 | 7/2018 | Craycraft et al. | |
| 2003/0020387 | A1 | 1/2003 | Wing et al. | |
| 2006/0226751 | A1 | 10/2006 | Park | |
| 2009/0051257 | A1 * | 2/2009 | Picken | F25D 25/024 312/408 |
| 2010/0102693 | A1 | 4/2010 | Driver et al. | |
| 2011/0001415 | A1 * | 1/2011 | Park | F25D 25/02 312/408 |
| 2011/0072846 | A1 | 3/2011 | Engel et al. | |
| 2011/0115356 | A1 | 5/2011 | Nash et al. | |
| 2011/0148268 | A1 | 6/2011 | Driver et al. | |
| 2012/0091084 | A1 | 4/2012 | Amaral et al. | |
| 2012/0223038 | A1 | 9/2012 | Bean | |
| 2016/0037923 | A1 | 2/2016 | Driver et al. | |
| 2017/0188707 | A1 | 7/2017 | Driver et al. | |
| 2018/0128538 | A1 * | 5/2018 | Jang | A47B 57/30 |

FOREIGN PATENT DOCUMENTS

| | | | |
|---|---|---|---|
| CN | 201779952 | U | 3/2011 |
| CN | 103900317 | A | 7/2014 |
| CN | 104896859 | A | 9/2015 |
| CN | 106766627 | A | 5/2017 |
| DE | 19750473 | A1 | 5/1999 |
| EP | 2379965 | A2 | 10/2011 |
| EP | 2926069 | A1 | 10/2015 |
| JP | 2002090054 | A | 3/2002 |
| KR | 431346 | B | 5/2004 |
| KR | 756887 | B1 | 9/2007 |
| KR | 894476 | B1 | 4/2009 |
| KR | 2013011827 | A | 1/2013 |
| WO | 2009155679 | A2 | 12/2009 |

* cited by examiner

REFRIGERATOR TUCK SHELF WITH FLUSH PROFILE AND CO-INJECTED FIXED GLASS

BACKGROUND

The present device generally relates to a shelf for a refrigerator. More particularly, the shelf includes a tucking front glass portion with a flush front shelf profile and a co-injected back glass substrate.

Various types of shelving units have been developed for use in a refrigerator. In one example, shelves with "tucking" front portions provide easy variation and adaptability to the storage arrangement provided within a refrigerator. Notably, the front portion of a tuck shelf can be fully extended, for example, along side members of the frame. Such an arrangement provides an extended shelving surface for storing small items. Alternately, according to various mechanisms, the front portion can be moved into a position beneath a rear half of the shelf to clear an open area along the front of the shelf through which taller items placed on a shelf below to extend through the open area. Some implementations of this type of shelving can be easily moved from the extended position to the tucked position, including inadvertently when objects are present on the tucking portion of the shelf, which can result in the objects being pushed off of the shelf or being otherwise susceptible to falling. Accordingly, further improvements may be desired.

SUMMARY

In at least one aspect, a refrigerator shelf includes a frame having laterally spaced-apart first and second side members. Each of the first and second side members defines opposite first and second ends. The frame further has a medial member extending between the first and second side members at respective locations between the first and second ends of the first and second side members, respectively. The first ends of the first and second side members define first and second portions of a front edge profile of the refrigerator shelf, respectively. The refrigerator shelf further includes a first substrate received between the first and second side members, defining a first edge, and moveable along the first and second side members between an extended position with the first edge adjacent the first ends of the first and second members and a tucked position with the front edge spaced away from the first ends. A trim member extends along an edge of the second substrate and defines a third portion of the front edge profile that is aligned with and physically engages with the first and second portions when the second substrate is in the extended position.

In at least another aspect, a refrigerator includes a housing defining an interior compartment with first and second parallel side walls, a rear wall and an open side. The refrigerator also includes a shelf mounted within the interior compartment. The shelf includes a frame having laterally spaced-apart first and second side members positionable parallel with the first and second side wall. Each of the first and second side members defines opposite first and second ends. A medial member extends between the first and second side members at respective locations between the first and second ends of the first and second side members. The first ends of the first and second side members define first and second portions of a front edge profile of the refrigerator shelf, respectively. The shelf also has a first surface portion received between the first and second side members, defining a leading edge, and moveable along the first and second side members between an extended position, with the leading edge aligned and physically engaged with the first and second portions of the front profile, and a tucked position with the leading edge spaced away from the first ends.

In at least another aspect, a refrigerator shelf includes a frame having laterally spaced-apart first and second side members, each defining opposite first and second ends, an edge member extending between the second ends of the first and second side members, and a medial member extending between the first and second side members at respective locations between the first and second ends of the first and second side members, respectively. The first and second side members define an open area on a side of the medial member opposite the edge member, and the first ends of the first and second side members define first and second portions of a front edge profile of the refrigerator shelf, respectively. A first substrate is fixedly received between the first and second side member, the edge member, and the rear member. A second substrate is received between the first and second side members and moveable along the first and second side members between an extended position in the open area and a tucked position aligned with and planar-adjacent the first substrate. A trim member extends along an edge of the second substrate and defines a third portion of the front edge profile that is aligned with and physically engages with the first and second portions when the second substrate is in the extended position.

These and other features, advantages, and objects of the present device will be further understood and appreciated by those skilled in the art upon studying the following specification, claims, and appended drawings.

DETAILED DESCRIPTION OF EMBODIMENTS

Figure 1:
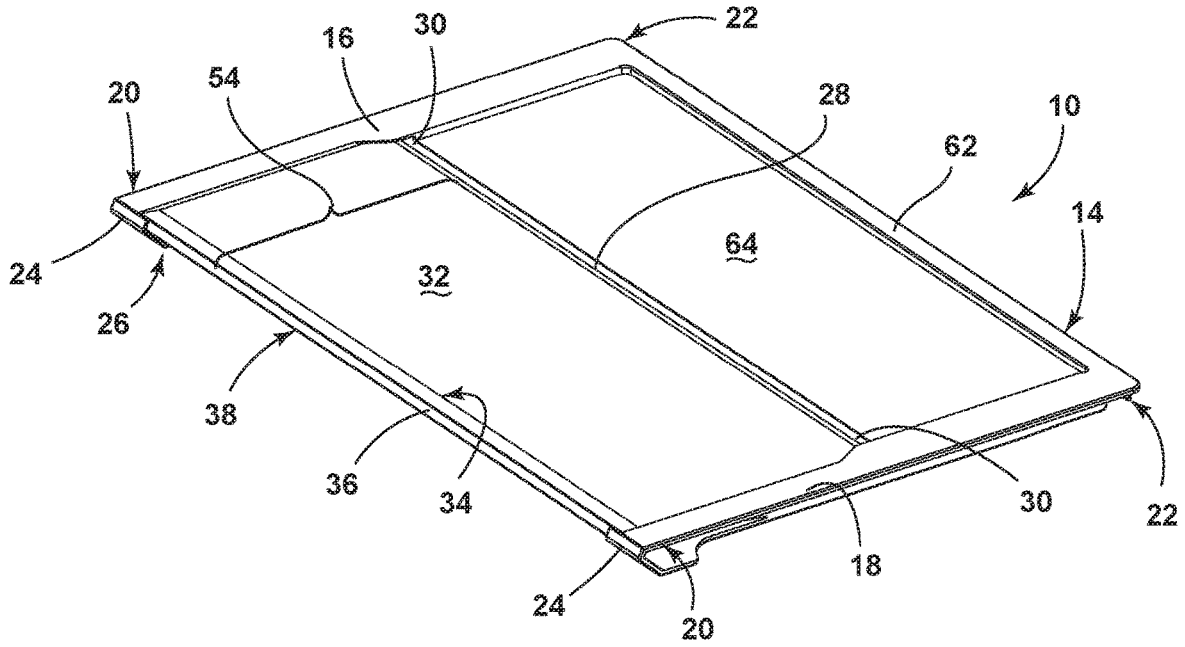
FIG. 1 is a front perspective view of a refrigerator shelf according to the disclosure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIG. 1, reference numeral 10 generally designates a shelf useable in a refrigerator 12. Refrigerator shelf 10 includes a frame 14 having laterally spaced-apart first and second side members 16,18. Each of the first and second side members 16,18 defines opposite first and second ends 20,22. In this respect, it is noted that the first and second side members 16,18 are generally mirror-images of each other and are, therefore, may be described with respect to only one of the first and second side members 16,18 with it being understood that the features described are mirror images on the opposite side member and are otherwise identical, unless it is specifically stated otherwise. The first ends 20 of the first and second side members 16,18 define respective side portions 24 of a front edge profile 26 of the refrigerator shelf 10.

The frame 14 further has a medial member 28 extending between the first and second side members 16,18 at respective locations 30 between the first and second ends 20,22 of the first and second side members 16,18, respectively. The refrigerator shelf 10 further includes a first substrate 32 received between the first and second side members 16,18. The first substrate 32 defines a first edge 34 and is moveable along the first and second side members 16,18 between an extended position (FIG. 1) with the first edge 34 adjacent the first ends 20 of the first and second side members 16,18 and a tucked position (FIG. 2) with the first edge 34 spaced away from the first ends 20. A trim member 36 extends along the first edge 34 of the first substrate 32 and defines a middle portion 38 of the front edge profile 26 that is aligned with and physically engages with the side portions 24 when the first substrate 32 is in the extended position.

Figure 3:
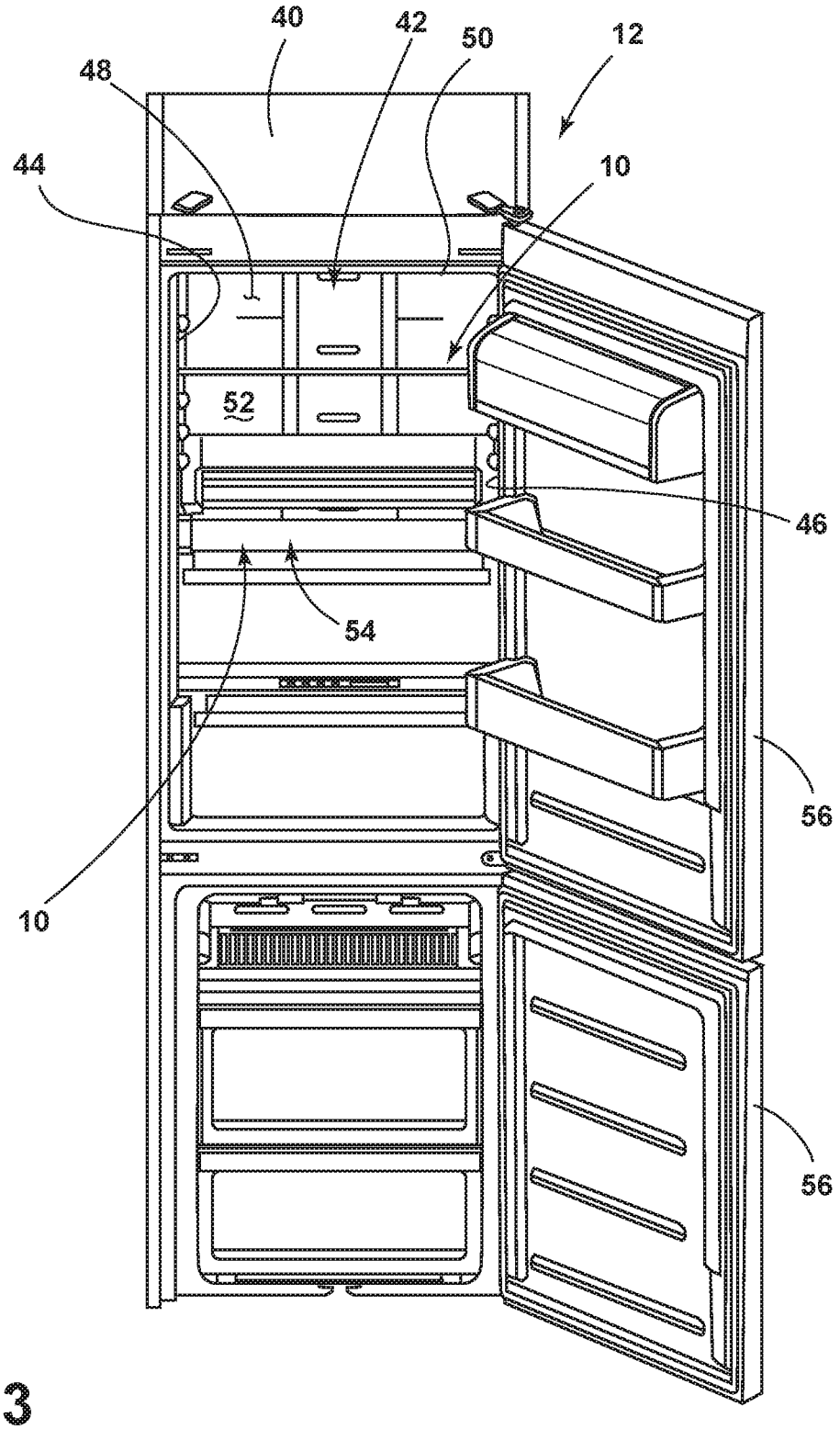
FIG. 3 is a front perspective view of a refrigerator including examples of the shelf of FIGS. 1 and 2.

As shown in FIG. 3, the shelf 10 described herein is configured for use in a refrigerator 12 that generally includes a housing 40 defining an interior compartment 42 with first and second parallel side walls 44,46, a rear wall 48 extending between the side walls 44,46, and an open side 50 extending between the side walls 44,46 opposite the rear wall 48. The refrigerator shelf 10 described herein is shown mounted within the interior compartment 42 with the first and second side members 16,18 positionable parallel with the first and second side walls 44,46. In particular, the shelf 10 is shown extending between the first side wall 44 and the second side wall 46 and positioned above an additional shelf 52 of a configuration typically found in a refrigerator and lacking the reconfigurable surface portion 54 defined by the above-described first substrate 32 and trim member 36. It is noted that the refrigerator 12 depicted herein is of a type that may be referred to as a bottom mount refrigerator 12, in which door 56 encloses the open side 50. Further, in the depicted arrangement, the compartment 42 in which the shelves 10 are mounted is a fresh food compartment 42, with the corresponding freezer compartment 43 positioned below the fresh food compartment 42 generally retaining articles in one or more drawers and enclosed by a separate lower door 57.

Shelf 10 may be useable or adapted to be useable in connection with variations of the depicted refrigerator 12, including top-mount refrigerators having a configuration wherein the positions of the fresh food compartment 42 and freezer compartments 43 are reversed. Shelf 10 may also be adapted for use in a French-door bottom mount refrigerator, in which two opposite doors cooperatively enclose the open side along respective portions thereof with the shelf 10 positioned against either the first side wall or the second side wall and extending to an adjacent shelf 52. Alternatively, the refrigerator may be a side-by-side arrangement with a narrow fresh food compartment with a similarly-narrow freezer compartment horizontally adjacent thereto. In such an arrangement, variations of the depicted shelf 10 can be made to fit within both the fresh food compartment and freezer compartments. In any such implementation, the ability to reconfigure shelf 10 by moving the surface portion 54 comprising the combined first substrate 32 and trim member 36 between the extended position (FIG. 1) and the tucked position (FIG. 2) can allow for shelf 10 to be alternately used to store articles on the first substrate 32 or to allow room for taller articles positioned on another shelf 52 beneath shelf 10 to extend into the open area 58 left between side members 16,18 when surface portion 54 is moved into the tucked position (FIG. 2).

As discussed herein, the assembled first substrate 32 and trim member 36 are collectively referred to as a surface portion 54, as the trim member 36 can be fixed with first substrate 32 such that it is not intended to be removed and such that the trim member 36 and the first substrate 32 move together between the described extended position and the tucked position. In the present example, the first substrate 32 can be of glass, including glass treated to be suitable in a refrigerator environment, examples of which include tempered glass, various laminated glasses, borosilicate glass, or other types of strengthened glass. In such an arrangement trim member 36 can be of the same material as frame 14 (which can include various plastics discussed further below) or metal, such as aluminum, stainless steel, zinc, magnesium, or various alloys thereof and can be coupled with first substrate 32 by a press fit, using various adhesives (or combinations thereof), or using mechanical fasteners, such as set screws or the like that can be hidden from view. Trim member 36 can be sized to provide a consistent visual look, as discussed further below, and to provide a grip for a user in moving surface portion 54 into and out of the tucked position, as also discussed further below, as well as to abut medial member 28 when surface portion 54 is in the tucked position.

Alternatively, the surface portion 54 can comprise a single structure with a substrate portion similar to the depicted first substrate 32 and a trim portion generally similar in structure to the described trim member 36. In various examples, such a single-piece surface portion 54 can be of a single piece of injection-molded plastic, including clear polycarbonate or the like or can be of a single piece of metal (e.g., aluminum, stainless steel, or the like) bent to define the trim portion adjacent the substrate portion with other additional variations being possible. In any such variation, the trim member 36 or the corresponding trim portion defines a leading edge 60 of the surface portion 54 includes a surface 62 that defines the middle portion 38 of the front edge profile 26. As with the first edge 34 of the first substrate 32, discussed above, the leading edge 60 of the surface portion 54 is aligned and physically engaged with the side portions 24 of the front edge profile 26 when the surface portion 54 is in the extended position (FIG. 1), and spaced away from the side portions 24 of the front edge profile 26 when surface portion 54 is in the tucked position (FIG. 2).

Figure 2:
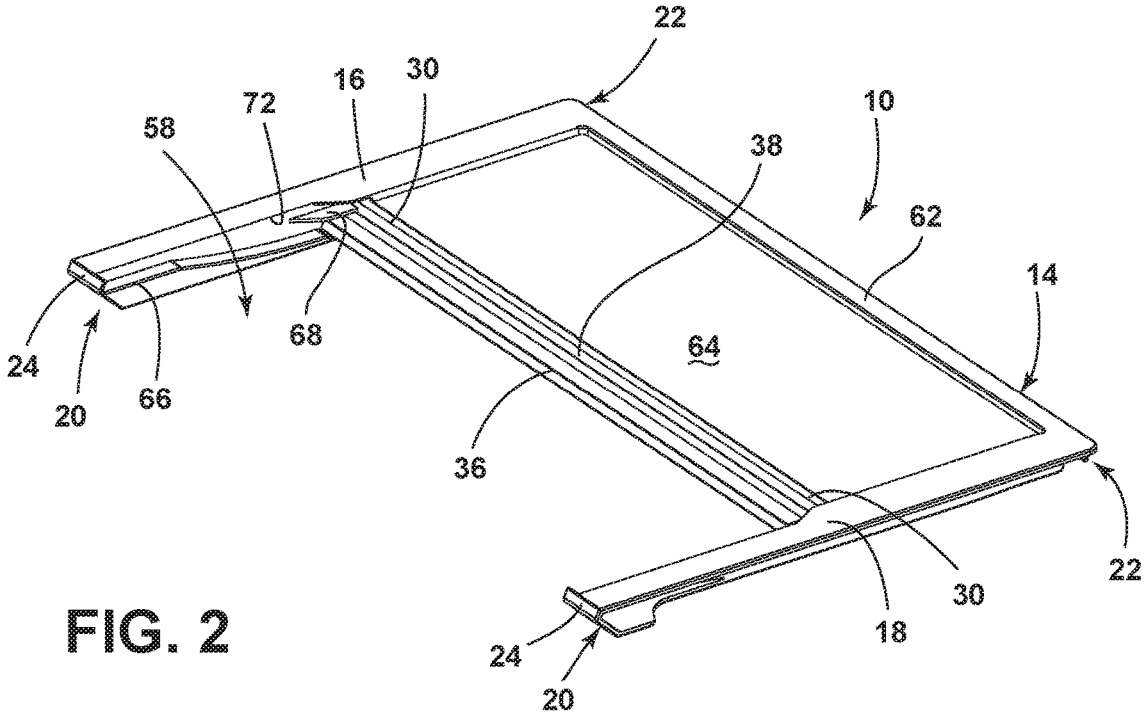
FIG. 2 is a front perspective view of the refrigerator shelf of FIG. 1 with a surface portion thereof in a tucked position.

As further shown in FIGS. 1-3, the frame 14 further includes an edge member 62 that extends between the second ends 22 of the first and second side members 16,18. The edge member 62 extends across what would be generally referred to as the back edge of the shelf 10 and is positionable adjacent the rear wall 48 of the interior compartment 42 of the refrigerator 12 when the shelf 10 is assembled therein. A second substrate 64 is received between the first and second side members 16,18, the edge member 62, and the medial member 28. The second substrate 64 is not intended to be moved and shelf 10 is not structured to facilitate movement or repositioning of second substrate 64. Accordingly, the second substrate 64 can be fixed in the above-described and illustrated position with respect to frame 14. In one example, the second substrate 64 is of glass and is fixedly received between the first and second side members 16,18, the edge member 62, and the medial member 28 by being co-injected with the frame 14. More particularly, the frame 14 can be of plastic, including polycarbonate, acrylonitrile butadiene styrene ("ABS"), or the like, and can be fabricated in a mold having a cavity or other structure to retain the second substrate 64 therein adjacent and extending partially into the portions of the mold defining the first and second side members 16,18, the edge member 62, and the medial member 28. In this manner, the molten plastic injected into the mold can surround the second substrate 64 to encapsulate the edges and portions of the major surfaces thereof. In the resulting structure, the second substrate 64 is generally permanently affixed with frame 14.

As discussed above, the surface portion 54 is moveable into the tucked position (FIG. 2) with the first edge 34 of the first substrate 32 is positioned away from the first ends 20 of the side members 16,18 and the leading edge 60, as defined on trim member 36 spaced from the side portions 24 also defined on the side members 16,18. As further shown, when in the tucked position, the first substrate 32 is aligned with and planar-adjacent the second substrate 64. In this manner, the planes defined by the respective expanses of the first and second substrates 32 and 64 are adjacent to each other (with corresponding sides thereof facing each other). As further shown, the first substrate 32 is aligned with the second substrate 64 in the vertical direction within the frame of reference of the refrigerator 12 depicted in FIG. 3, with the first substrate 32 being generally beneath the second substrate 64. In a similar manner, when the first substrate 32 is in the extended position, it can be characterized as being edge-adjacent the second substrate 64. Again, when the surface portion 54 is in the tucked position, the first and second side members 16,18 define the open area 58 on a side (the front side with respect to the refrigerator shown in FIG. 3 and adjacent to and facing the open side 50 of the housing 40) of the medial member 28 opposite the edge member 62. Conversely, the first substrate 32 is positioned within and generally spans the open area 58 when in the extended position (FIG. 1). In this manner, the medial member 28 can be located approximately half way between the first and second ends 20,22 of the side members 16,18, as dictated by the above-described locations 30 at which the medial member 28 extends from each of the side members 16,18, respectively. In one example, the extension locations 30 can be positioned along the middle 10% of the side members 16,18 (i.e., positioned between 45% and 55% of the distance away from the first ends 20 and toward the second ends 22. Such positioning can be such that the longitudinal sizes of the first substrate 32 and the second substrate 64 are generally comparable (with some allowance for the first edge 34 of the first substrate 32 to remain forward of the medial member 28 when in the tucked position to allow for the user to grasp trim member 36 to reposition the surface portion 54 into the extended position.

Figure 4:
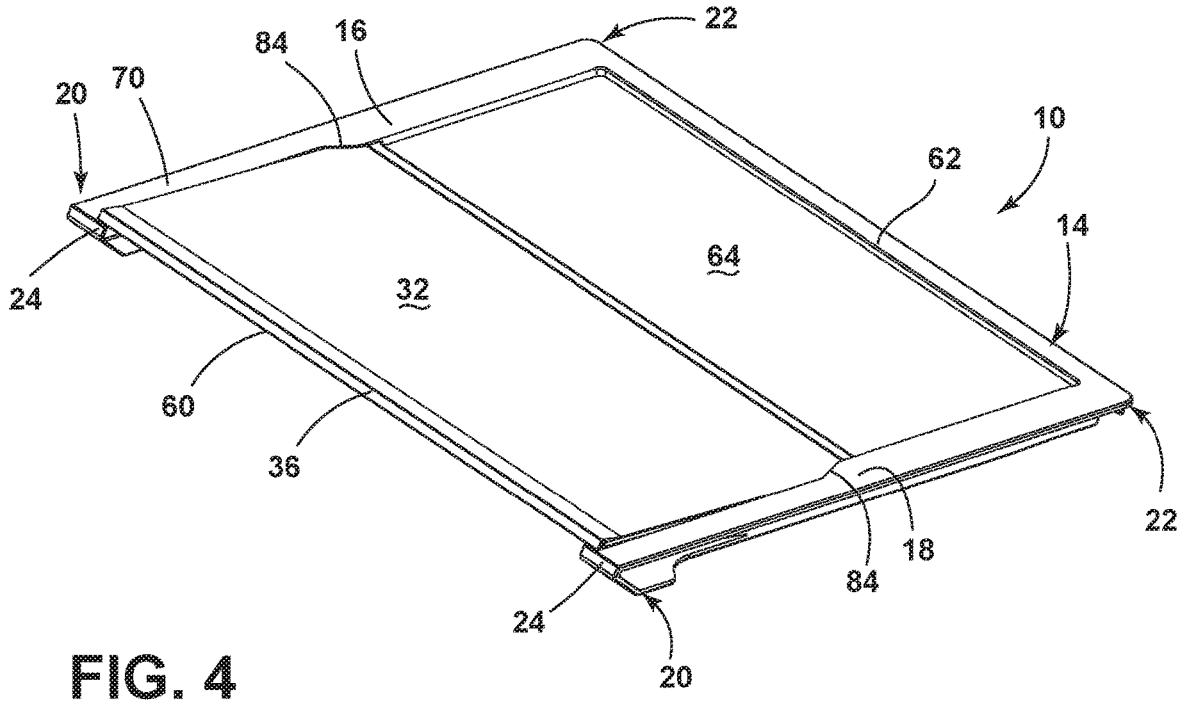
FIG. 4 is a front perspective view of the refrigerator shelf of FIG. 1 with a leading edge of the surface portion in a disengaged position.
Figure 5:
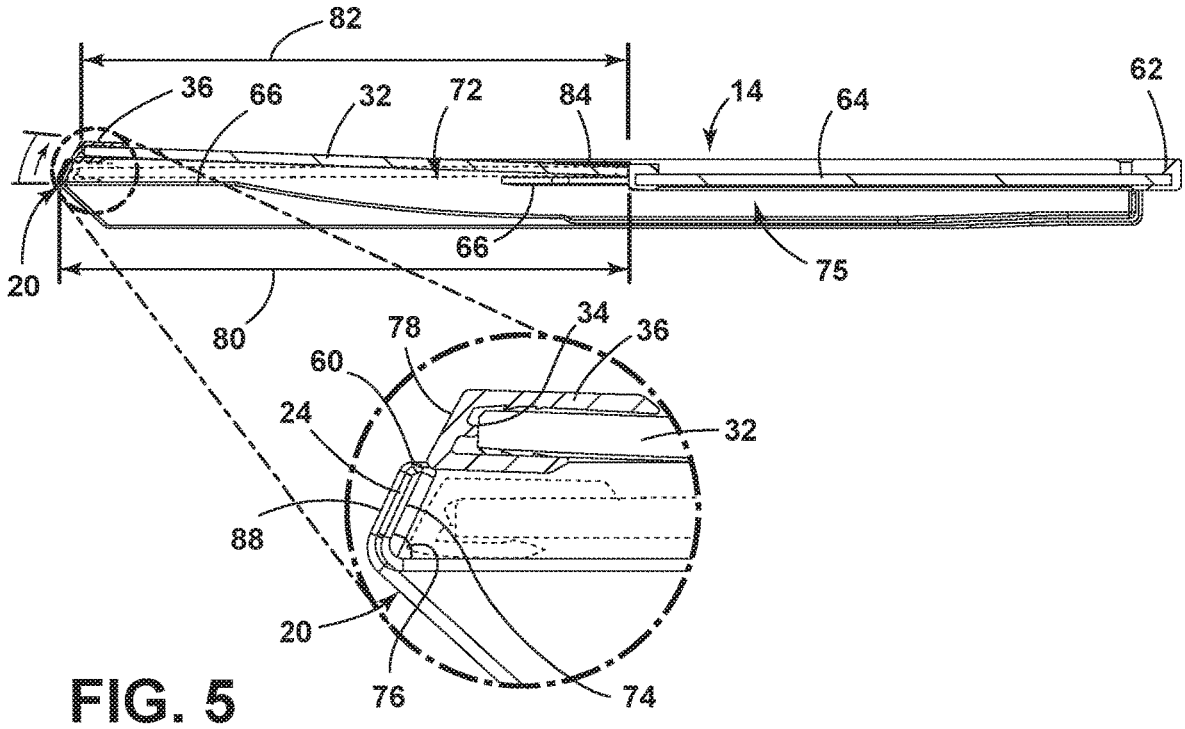
FIG. 5 is a side cross-section view of the refrigerator shelf of FIG. 4.
Figure 6:
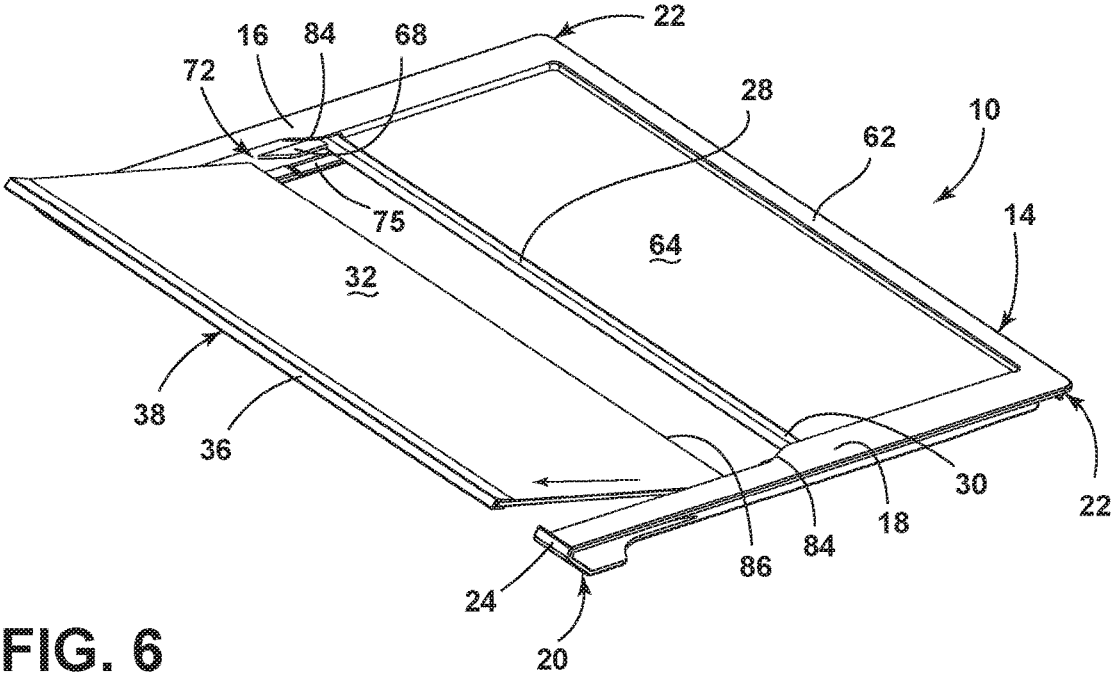
FIG. 6 is a front perspective view of the shelf of FIG. 1 with the surface portion moved off of supporting ledges and into an open area of the shelf frame.
Figure 7:
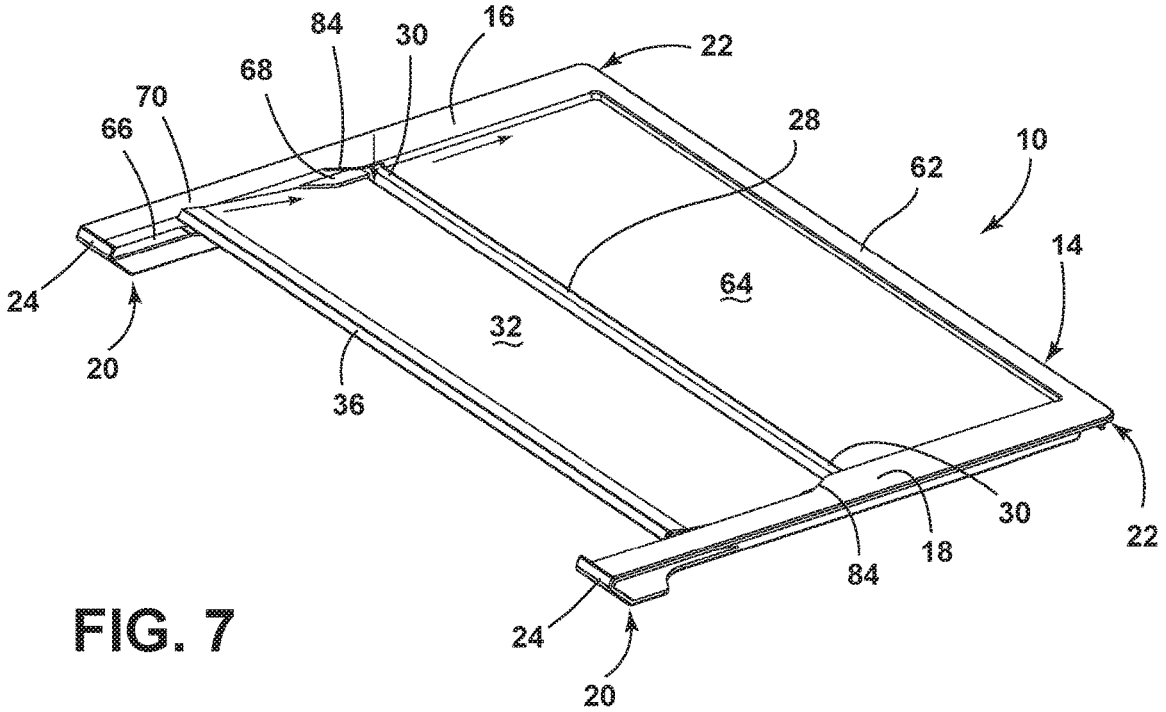
FIG. 7 is a front perspective view of the shelf of FIG. 1 with the surface portion moved toward the tucked position.

As shown in FIGS. 4-7, each of the side members 16,18 defines a first ledge 66 adjacent the first end 20 thereof. Each ledge 66 extends away from the first end 20 toward the second end 22 (i.e., in a rearward direction). Similarly, each side member 16,18 includes a second ledge 68 adjacent the medial member 28 and extending away therefrom toward the first end 20 of the respective side member 16,18. In this arrangement, the first substrate 32 is positionable so as to rest on the ledges 66,68 when in the extended position. The ledges 66,68 are positioned vertically below the adjacent upper surfaces 70 of the side members 16,18 such that first substrate 32 is recessed within frame 14, including when supported on side members 16,18 in the extended position. On each side member 16,18 the first ledge 66 and second ledge 68 are spaced apart along the length of the respective side member 16,18 to define an open area 72 therebetween. In this manner, the first substrate 32 is releasably retained in the extended position on ledges 66,68 so as to be moveable into the tucked position by movement off of the first and second ledges 66,68 and through the open area 72, as shown in FIGS. 6 and 7, in particular. Once the first substrate 32 is positioned within and through the open area 72, the first substrate 32 can be moved into tracks 75 (FIG. 7) that are in communication with open area 72 and extend along side members 16,18 beneath second substrate 64 such that first substrate 32 can be moved into the tucked position of FIG. 2. Surface portion 54 can be moved out of the tucked position, essentially, by reversing the process just described, including by moving trim member 36 forward and upward within tracks 75 to move the first edge 34 of the first substrate 32 through the open area 72 such that the back edge 86 of substrate can be placed on second ledges 68 and beneath upper flanges 84. Surface portion 54 can then be rotated downwardly to engage the middle portion 38 of front edge profile 26 with the side portions 24.

As can be appreciated, inadvertent movement of surface portion 54 out of the extended position could cause articles stored thereon to become dislodged from first substrate 32 and could cause such article to fall. Accordingly, frame 14 and surface portion 54 are configured to interact to prevent such inadvertent movement. In particular, side members 16,18 and surface portion 54 are configured such that movement of the first substrate 32 off of the second ledges 68 is carried out by movement of the first edge 34 of the first substrate 32, by way of trim member 36, past the first ends 20 of the first and second side members 16,18 in the forward direction (i.e., in a direction away from the medial member 28). The above-mentioned physical engagement of the middle portion 38 of the front edge profile 26, as defined on trim member 36, with the side portions 24 of the front edge profile 26 restricts movement of the first edge 34 of the first substrate 32 in the forward direction (away from the medial member 28) when the first substrate 32 is positioned on the first ledges 66.

More particularly, as depicted in FIG. 5, the side portions 24 of the front edge profile 26 define inner portions or faces 74 that extend upward away from the corresponding first ledges 66 at acute angles 76 with respect to the first ledges 66. In this arrangement, the face 78 of trim member 36 that defines the middle portion 38 of the shelf front edge profile 26 is oriented generally parallel to the inner faces 76 of the side portions 24 of the profile 26 such that when surface portion 54 is in the extended position, the face 78 of trim member can be at least partially positioned beneath inner face 74. As shown, the distance 80 between medial member 28 and inner face 74, when measured adjacent second ledge 68 is greater than the total depth 82 of surface portion 54

(i.e., at its longest point, at the leading edge 60), meaning that some longitudinal (i.e. toward and away from medial member 28) movement of surface portion 54 is possible within what can be considered the extended position of surface portion 54. In this manner, when first substrate 32 is moved somewhat away from medial member 28, the front face 78 of trim member 36 becomes engaged with the faces 74 of the side portions 24 of the shelf front edge profile 26 in that the front face 78 actually contacts faces 74 or such that upward movement of trim member 36 brings face 78 into contact with faces 74. In this manner, for most of the range of placement of surface portion 54 in the extended position, the initial upward movement of trim member 36 will force surface portion 54 rearward to bring first substrate 32 into contact with medial member 28, thereby providing additional resistance to prevent inadvertent upward movement of trim member 36.

In some variations, the distance 80 between inside faces 74 and medial member 28 can be such that the front face 78 of trim member 36 remains engaged with side portions 24 of the front edge profile 26 even when first substrate 32 is in contact with medial member 28. Such a configuration is such that some outward deformation or other deflection of side portion 24 is required to move trim member 36 upward to the extent needed to disengage the middle portion 38 of front edge profile 26 from the side portions 24, as shown in FIGS. 4 and 5. In either configuration, it is noted that the upward movement of trim member 36 is achieved by overall rotation of surface portion 54 about a point adjacent medial member 28. In particular, in FIGS. 4 and 6 it can be seen that side members 16,18 also include upper flanges 84 spaced apart from and facing second ledges 68 such that the portion of first substrate 32 adjacent medial member 28 in the extended position is captured between second ledges 68 and upper flanges 84. In this manner, the movement of first substrate 32 is restricted such that the first edge 34 thereof is moveable upward to move first substrate 32 off of the first ledges 66 with the opposite edge 86 is retained close to second flanges 68, with upper flanges 84 being spaced from second ledges 68 at a vertical distance sufficient to allow such rotation at least to an extent needed for the above-described disengagement.

By the above configuration, it can be appreciated that the depictions of shelf 10 in FIGS. 4, 6, and 7 show a sequence of steps in moving surface portion 54 from the extended position of FIG. 1 to the tucked position of FIG. 2. In particular, in FIG. 4 it is shown that trim member 36 is initially lifted upward under rotation of first substrate 32 about the back edge 86 thereof to disengage the middle portion 38 of front edge profile 26 from the side portions 24. Surface portion 54 is then moved forward to move first substrate 32 off of the second ledges 68 and to position at least the back edge 86 through the open area 72 and into the tracks 75. Subsequently, as shown in FIG. 7, surface portion 54 is moved rearwardly (i.e. with the first edge 34 of first substrate 32 moving toward medial member 28) such that first substrate 32 moves entirely into the tracks 75 of side members 16,18, with the open area 72 between the first ledges 66 and the back ledges 68 being sized to accommodate such movement. With first substrate 32 thusly positioned, surface portion 54 can be moved further rearwardly until it reaches the tucked position of FIG. 2 with trim member 36 contacting medial member 28 and first substrate 32 positioned beneath second substrate 64.

Figure 8:
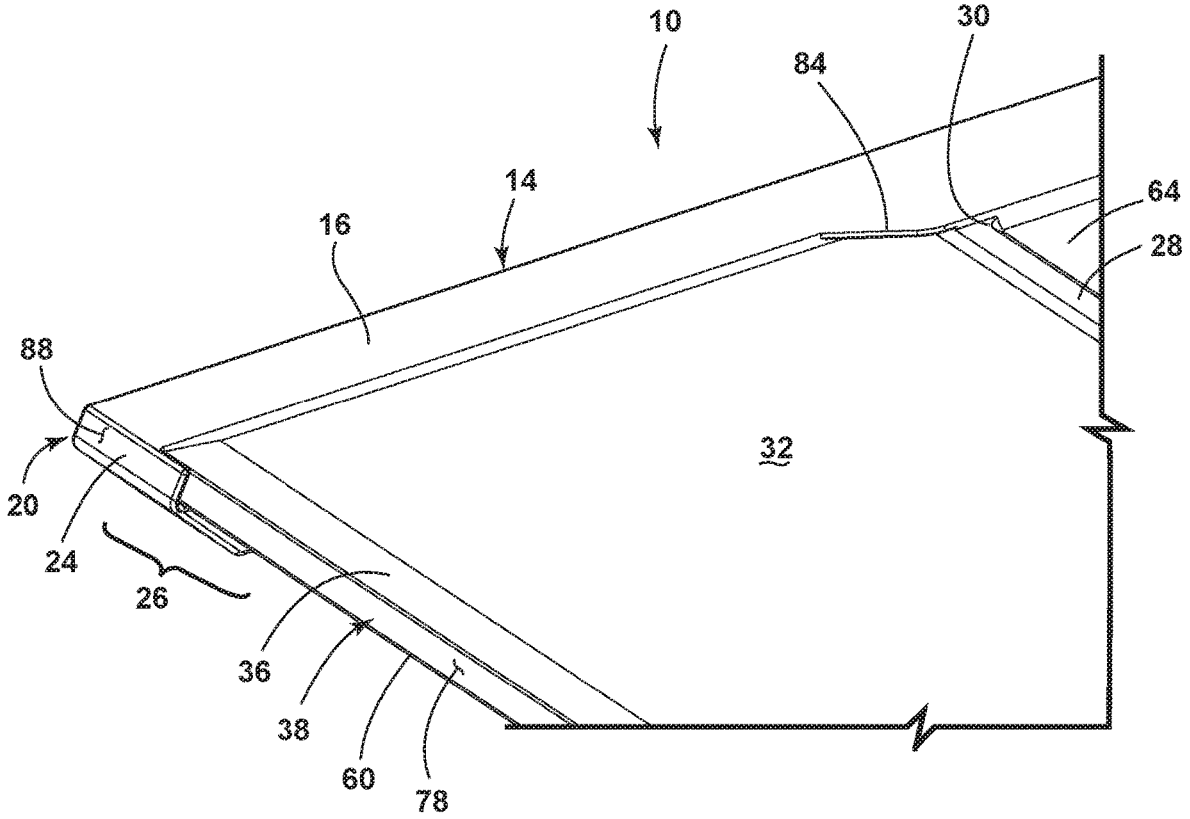
FIG. 8 is a detail view of the refrigerator shelf of FIG. 1 showing engagement of a leading edge of the surface member with a front profile of the frame.

As shown in FIG. 8, the side portions 24 of the front edge profile 26 also define outer faces 88 that are generally parallel with the inner faces 74 and offset from therefrom by the material thickness of side members 16, 18, respectively. In this manner, the front face 78 of trim member 36 and the outer faces 84 of the side portions 24 face outwardly and are generally parallel with each other. This arrangement provides a consistent, flush visual appearance for the front edge profile 26, while providing visual ques to the user as to the engagement of the middle portion 38 of the front edge profile 26 with the side portions 24 and the general upward and rearward movement to be imparted on trim member 36 for repositioning of surface portion 54 into the tucked position.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigerator shelf, comprising:

a frame including laterally spaced first and second side members, each defining opposite first and second ends, each of the first and second ends defining first and second portions of a front edge profile of the refrigerator shelf, respectively, and a medial member extending between the first and second side members at respective locations between the first and second ends of the first and second side members, respectively;

a first substrate received between the first and second side members, defining a first edge, and directly supported on the first and second side members so as to be moveable along the first and second side members between an extended position with the first edge adjacent to the first ends of the first and second side members and a tucked position with the front edge spaced away from the first ends; and a trim member extending only along the first edge of the first substrate and defining a third portion of the front edge profile that is aligned with and physically engages with the first and second portions when the first substrate is in the extended position.

2. The refrigerator shelf of claim 1, wherein the frame further includes:

an edge member extending between the second ends of the first and second side members; and a second substrate fixedly received between the first and second side members, the edge member, and the edge medial member.

3. The refrigerator shelf of claim 2, wherein the second substrate is of glass and is fixedly received at respective portions thereof by the first and second side members, the edge member, and the medial member by being co-injected with the frame.

4. The refrigerator shelf of claim 2, wherein the first substrate is aligned with and planar-adjacent to the second substrate when in the tucked position.

5. The refrigerator shelf of claim 2, wherein:

the first and second side members define an open area on a side of the medial member opposite the edge member; and the first substrate is positioned within the open area when in the extended position.

6. The refrigerator shelf of claim 1, wherein each of the first and second side members defines:

a first ledge adjacent the first end and extending toward the second end; and a second ledge adjacent the medial member and extending toward the first end;

wherein the first ledge and the second ledge are spaced apart to define an open area therebetween.

7. The refrigerator shelf of claim 6, wherein:

the first substrate is positionable on the first and second ledges to releasably retain the first substrate in the extended position; and the first substrate is moveable into the tucked position by movement off of the first and second ledges and through the open area.

8. The refrigerator shelf of claim 7, wherein:

the movement of the first substrate off of the second ledge includes movement of the first edge of the first substrate past the first ends of the first and second side members in a direction away from the medial member; and physical engagement of the third portion of the front edge profile of the trim member with the first and second portions of the front edge profile restricts movement of the first edge of the first substrate in the direction away from the medial member when the first substrate is positioned on the first ledge.

9. The refrigerator shelf of claim 8, wherein movement of the first edge of the first substrate in the direction away from the medial member also includes rotation of the first substrate to move the first edge away from the first ledge and disengage the trim member from the first and second portions of the front edge profile.

10. The refrigerator shelf of claim 7, wherein each of the first and second side members further defines a track in communication with the open area and extending past the medial member.

11. The refrigerator shelf of claim 6, wherein:

the first and second portions of the front edge profile define inner portions extending at an acute angle with respect to respective first ledges and outer portions parallel with the inner portions; and the third portion of the front edge profile defines a face parallel with and contacting the inner portions of the first and second portions when the first substrate is in the extended position.

12. A refrigerator, comprising:

a housing defining an interior compartment with first and second parallel side walls, a rear wall and an open side;

a shelf mounted within the interior compartment and including:

a frame including laterally spaced-apart first and second side members positionable parallel with the first and second side walls, each of the first and second side members defining opposite first and second ends, each of the first and second ends defining first and second portions of a front edge profile of the shelf, respectively, and a medial member extending between the first and second side members at respective locations between the first and second ends of the first and second side members, respectively;

a first surface portion received between the first and second side members, defining a leading edge, and moveable along the first and second side members between an extended position, with the leading edge having a face aligned with and contacting respective inner portions of the first and second portions of the front profile, and a tucked position with the leading edge spaced away from the first ends.

13. The refrigerator of claim 12, wherein the first surface portion includes:

a first substrate received between the first and second side members and defining a first edge; and a trim member extending along the first edge of the first substrate and defining the leading edge of the surface portion.

14. The refrigerator of claim 12, wherein each of the first and second side members defines:

a first ledge adjacent the first end and extending toward the second end; and a second ledge adjacent the medial member and extending toward the first end;

wherein the first ledge and the second ledge are spaced apart to define an open area therebetween.

15. The refrigerator of claim 14, wherein:

the first surface portion is positionable on the first and second ledges to releasably retain the first surface portion in the extended position; and the first surface portion is moveable into the tucked position by movement off of the first and second ledges and through the open area.

16. The refrigerator of claim 15, wherein:

movement of the first surface portion off of the second ledge includes movement of the leading edge of the first surface portion past the first ends of the first and second side members in a direction away from the medial member; and contact of the face of the leading edge of the first surface portion with the inner portions of the first and second portions of the front edge profile restricts movement of the leading edge of the first surface portion in the direction away from the medial member when the first surface portion is positioned on the first ledge.

17. The refrigerator of claim 16, wherein the movement of the leading edge of the first surface portion in the direction away from the medial member also includes rotation of the first surface portion to move the leading edge away from the first ledge and disengage the leading edge from the first and second portions of the front edge profile.

18. The refrigerator of claim 15, wherein each of the first and second side members further defines a track in communication with the open area and extending past the medial member.

19. The refrigerator of claim 14, wherein:

the first and second portions of the front edge profile define inner portions extending at an acute angle with respect to respective first ledges and outer portions parallel with the inner portions; and the leading edge of the first surface portion defines a face parallel with and contacting the inner portions of the first and second portions when the first surface portion is in the extended position.

20. A refrigerator shelf, comprising:

a frame:

including laterally spaced-apart first and second side members, each defining opposite first and second ends, an edge member extending between the second ends of the first and second side members, and a medial member extending between the first and second side members at respective locations between the first and second ends of the first and second side members, respectively, wherein:

the first and second side members defining an open area on a side of the medial member opposite the edge member; and the first ends of the first and second side members each defining first and second portions of a front edge profile of the refrigerator shelf, respectively;

a first substrate movably received between the first and second side members;

a second substrate fixedly received at respective portions thereof by the first and second side member, the edge member, and the rear member, the first substrate being moveable along the first and second side members between an extended position in the open area and a tucked position aligned with and planar-adjacent the first substrate; and a trim member extending along a first edge of the first substrate and defining a third portion of the front edge profile that is aligned with and physically engages with the first and second portions when the second substrate is in the extended position.

* * * * *